US010865515B2

(12) United States Patent
Iyidogan et al.

(10) Patent No.: US 10,865,515 B2
(45) Date of Patent: Dec. 15, 2020

(54) PROCESS OF TEXTILE FINISHING AND FINISHED TEXTILES

(71) Applicant: Sanko Tekstil Isletmeleri San. Ve Tic. A.S., Bursa (TR)

(72) Inventors: Deniz Iyidogan, Bursa (TR); Ozgur Cobanoglu, Bursa (TR); Gokhan Kaplan, Bursa (TR); Leyla Zengi, Bursa (TR); Sabrettin Akbulut, Bursa (TR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 0 days.

(21) Appl. No.: 16/583,543

(22) Filed: Sep. 26, 2019

(65) Prior Publication Data

US 2020/0102696 A1 Apr. 2, 2020

(30) Foreign Application Priority Data

Sep. 27, 2018 (EP) ..... 18197216

(51) Int. Cl.
*D06C 29/00* (2006.01)
*D06M 11/74* (2006.01)

(52) U.S. Cl.
CPC ..... *D06M 11/74* (2013.01); *D06C 29/00* (2013.01)

(58) Field of Classification Search
CPC .. D06C 29/00; D06M 15/564; D06M 15/507; D06M 11/74
USPC ..... 8/115.6
See application file for complete search history.

(56) References Cited

U.S. PATENT DOCUMENTS

2009/0155589 A1* 6/2009 Aikyou ..... C01B 32/05 428/402
2011/0143107 A1 6/2011 Steinig-Nowakowski et al.
2015/0140319 A1 5/2015 Qi et al.

FOREIGN PATENT DOCUMENTS

CN 105 316 792 2/2016
KR 100 785 886 12/2007

OTHER PUBLICATIONS

European Search Report issued by the EPO dated Mar. 29, 2019 for EP priority application No. 18197216.7.
International search report issued by the EPO dated Jan. 2, 2020 for corresponding International application No. PCT/EP2019/076108.

* cited by examiner

*Primary Examiner* — Eisa B Elhilo
(74) *Attorney, Agent, or Firm* — Silvia Salvadori

(57) ABSTRACT

The present invention relates to a process of finishing a textile to impart a shiny effect to such textile comprising the step of preparing a composition containing 2D carbon microparticles in a carrier, applying said composition to said textile and drying said textile carrying said composition. The present invention also relates to a textile, a fabric and yarn coated with the composition above. The present invention finally relates to uses of 2D carbon microparticles to provide a shiny effect on textiles.

17 Claims, 5 Drawing Sheets

PROCESS OF TEXTILE FINISHING AND FINISHED TEXTILES

This Application is a U.S. Non-provisional application which claims priority to and the benefit of European Patent Application EP18197216.7 filed on 27 Sep. 2018, the content of which is incorporated herein by reference in its entirety.

The present invention relates to a process of finishing textiles and to the textiles finished with such process. In greater detail, the invention relates to a method of producing modified textiles which includes 2D carbon microparticles.

Finishing processes for textiles are a group of heterogeneous processes that improve the look, the performance and/or the "hand" (feel) of the finished textiles or clothing. Common finishing processes that improve the look of the textiles are stone washing, bleaching, printing and imparting a shiny effect, i.e. a glitter effect.

Shiny effect on textiles can be obtained by known finishing processes, such as calendering process or by addition of glitters to textiles. Glitters are small particle size powders, generally made of mica or metal pigments, that transfer a high reflective property to the textiles. Traditionally, in this field of application, the pigment used are the so called "effect pigments", that are able to provide optical effects to the coated textile substrates. "Effect pigments" provide a high reflective property, e.g. a metallic-like or glitter effect, to the textiles they are applied to. Typical effect pigments used are metal particles such as gold bronze pigments leading to a red copper metallic appearance of the treated fabric. Other known pigments are metal particles of copper, aluminium, silver, iron or glass flakes that are silver coated.

Obtaining a shiny effects with glitters provides two major drawbacks. The first one is related to the extremely small particle size of glitters, which causes them to be hard to handle, to fly around and to adhere to most surfaces through electrostatic interactions. This causes problems when applying glitters to textiles and when cleaning the equipment and machinery used to apply glitters. The second drawback is the wash performance, for both textile manufacturer and end users: glitters are not inert against many chemicals and mechanical forces and the shiny effect they impart to the textiles they are applied to is greatly and permanently reduced after one or few more washes or after other finishing processes. To avoid permanent reduction of the shiny effect, mild conditions during washing or other finishing processes are required when treating textiles having glitters.

A need of the art is thus to provide a process that may impart optical effects, such as a shiny appearance, to textiles.

SUMMARY OF THE INVENTION

It is an aim of the present invention to solve the above problems and to provide a method to obtain a textile with a pigment that can impart a shiny effect, i.e. an optical effect on a textile, said effect including a metallic-like or glitter effect or gloss effect.

Said aim is reached by the present invention, which provides a process of treating, in particular finishing, textiles according to claim 1. In an embodiment, the process comprises the steps of preparing a composition containing carbon microparticles in a carrier, the particles being 2D, i.e. in the shape of "microsheets" or "microsurfaces", applying the composition to textiles and drying the textiles carrying the composition to provide a shiny effect to the textiles.

In greater detail, a 2D carbon microparticle useful for the invention is a particle having dimensions comprised in the range of 0.1 to 250 microns, preferably of 10 to 225 microns, more preferably of 43 microns to 125 microns, inclusive.

With the wording "2D microparticles" it is here meant a microparticle in which the thickness is few nanometers and the length of the major axis in the range of microns, e.g. the ranges provided above. Suitable micro particles are π-π stacked multilayer graphene particles or graphite flakes.

It was found that 2D carbon microparticles, preferably of the above mentioned dimensions, can behave as an effect pigment. In particular, carbon microparticles can impart to the textile to which they are applied (i.e. the treated textile) a shiny effect (or a glitter effect or a metallic-like effect or a gloss effect). The shiny effect provided by the 2D carbon microparticles can be temporarily reduced by treating the coated textile with treatments such as washing, however such shiny effect is substantially restored when the coated textile is treated e.g. with a further mechanical stress step, such as application of pressure on the treated and washed textile.

In the present invention, for "shiny effect" or "gloss effect" or "glitter effect" it is meant the optical effect providing brightness and sparkling to the surface of the textile. Such effect can be due to light reflection, in particular reflection in almost a specular (mirror-like) direction, provided by the 2D carbon microparticles covering at least some parts of the surface of the textile treated according to the process of the invention. The shiny effect of the fabric can be measured by determining the percentage of the area showing shiny effect with respect of the fabric surface considered for the measurement, preferably according to the method disclosed more in detail below.

In the present description, "textiles" is used to define yarns, fabrics, and garments.

The invention also relates to a textile obtainable with the above mentioned process.

Textiles that may be treated with the invention process are mainly those from natural fibers, especially cellulose, regenerated cellulose, bamboo, kapok, hemp, flax, sisal, etc. Additionally, synthetic fibers, yarns and/or fabrics made e.g. of polyester, polyethylene terephthalate, polyamides (incl. PA6, PA66, PA612, PA11) can benefit from such an effect as well.

The compositions containing microparticles of the invention comprises carbon microparticles, a carrier, and can contain auxiliary chemicals.

Suitable carriers are transparent, or substantially transparent, whereby they do not hinder or obstruct the gloss effect provided by the 2D carbon microparticles. Suitable carriers may be polymers based on polyurethane, with polyether polyurethane being preferred. Suitable auxiliary chemicals are e.g. thickening agents, wetting agents, softening agents and de-foaming agents.

The invention also relates to a fabric comprising a coating on at least part of at least a surface thereof, characterized in that such coating contains 2D carbon microparticles in a carrier as herein disclosed. The coating can be advantageously applied carrying out the process of the invention. According to the present invention, only one surface of such fabric can be provided with the composition containing 2D carbon microparticles in a carrier; accordingly, the coated surface provides the shiny effect, while the non-coated surfaces does not.

The invention also relates to a yarn comprising a coating on at least part of its surface, characterized in that such coating contains 2D carbon microparticles in a carrier as disclosed herein. It has been surprisingly found that a fabric manufactured (i.e. woven) with the yarns coated with the composition as herein disclosed, preferably coated according to the process of the invention, exhibits the shiny effect; such shiny effect is showed in turn by the garment manufactured with such fabric.

The invention also relates to a garment comprising at least one of the yarns and/or the fabrics as above defined. Preferably, such yarns and/or fabrics are at least in part located on the outer surface of the garment. The outer surface of a garment is the surface that is not facing the user whilst he/she wears such garment. The garment of the invention is therefore preferably manufactured so that at least part of the coated surface of the fabric and/or yarn is located in the outer surface of such garment.

The invention also relates to the use of 2D carbon microparticles as herein disclosed, as well as of the composition containing 2D carbon microparticles in a carrier as herein disclosed, to provide a shiny effect on textiles.

The invention provides several advantages over the prior art. In fact, 2D carbon microparticles resulted to be inert against most chemicals, thermal and mechanical conditions, and thus the shiny effect provided by carbon microparticles according to the process of the invention is not greatly and permanently reduced or lost under most conventional treatments that the treated textile may be subjected to, such as other finishing treatments or wash treatments.

Moreover, it was found that carbon microparticles, especially of the particle size comprised in the range as above described, provide good performance balance in between colour coverage and reflection parameters, and are compatible with commercial dyes (e.g. blue, red, black, brown) currently used in the textile field. Additionally, handling of 2D carbon microparticles is easier compared to the handling of conventional glitter materials; carbon microparticles thus result more suitable for technological processes (such as the preparation of the compositions containing them) than conventional glitters.

DETAILED DESCRIPTION OF THE INVENTION

The invention will now be further disclosed in more detail with reference to the following non-limiting examples and figures.

Figure 1:
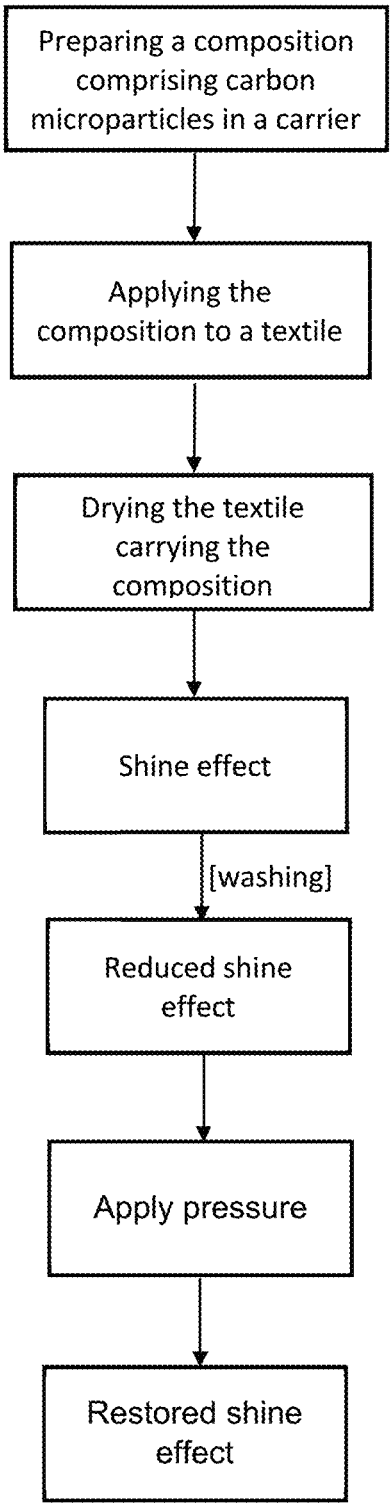
FIG. 1 is a flowchart showing embodiments of the process of the invention.

The invention process provides for preparing a composition containing carbon microparticles, treating a textile with the said composition, and drying the textiles carrying said composition. A flowchart showing the process above explained is represented on FIG. 1.

The composition to be applied on the textile according to the invention have to contain carbon microparticles as disclosed above, i.e. 2D particles, meaning in the shape of "microsheets" or "microsurfaces", such as graphite flakes, having a size comprised in the range from 0.1 to 250 microns, preferably of 10 to 225 microns, more preferably of 44 microns to 125 microns; size measurements were done with an optical microscope and Malvern Dynamic Light Scattering.

The textile is selected from yarns, fabrics and garments. Carrying out the process of the invention on yarns provide the shiny effect on such yarn, which is maintained on a woven fabric that is obtained from these yarns. Fabrics treated according to the process of the invention can be subsequently used to provide a garment, which will exhibit the shiny effect.

The carbon microparticles providing the shiny effect are applied to the textile by means of a composition containing a carrier in which the carbon microparticles are dispersed. The carrier can be any suitable dispersant of carbon microparticles, and is preferably transparent, meaning that it has the property of transmitting light without appreciable scattering so that bodies lying beyond and/or dispersed therein can be seen. The carrier can also be substantially transparent. The carrier according to the invention is such as to let the microparticles to move within the polymer matrix and to align, e.g. under a (mechanical) pressure. A suitable carrier can be thus a transparent polymer, such as a polymer based on polyurethane, and such carrier is preferably at least a polyurethane selected from polyether polyurethane, polyester polyurethane, and polyether polyester polyurethane; more preferably is polyether polyurethane. Advantageously, polyurethane can be synthesized in situ while preparing the composition containing the carbon microparticles, e.g. by reacting polyol with polyisocyanate For example, polyurethane can be synthesized in situ while preparing the composition by dispersing the carbon microparticles in polyol and then adding and mixing polyisocyanate before the application of the composition on the textile, or alternatively by reacting polyol with polyisocyanate and dispersing the carbon microparticles in the so-formed polyurethane.

The composition can be prepared by any method that effectively disperse the carbon microparticles within the carrier. The dispersion can be stabilized, if needed, by suitable agents, such as surfactants. The amount of microparticles comprised in the composition can be in the range of 15 g/kg to 60 g/kg, preferably 20 g/kg to 50 g/kg of the dry composition, i.e. of the composition without solvent.

The composition is applied to a textile in a known method. Suitable processes for applying the composition to a textile are e.g. coating, printing, padding.

It was found out that a suitable shiny effect is obtained on the textile when the application of the composition to the textile align the microparticles contained in the composition so that they can reflect the light to provide a glitter effect. For example, a suitable shiny effect is obtained when the application of the composition to the textile includes applying a pressure (such as a mechanical pressure) on the composition to spread it on the textile, as it happens e.g. in screen printing and knife coating. More generally, a suitable method of applying mechanical stress to the composition containing the microparticles is any application in which the microparticles can be at least partially rotated or moved within the carrier and in which applied pressure can let them rotate and/or align such that the reflection of light from each particle has similar angular distributions, hence creating the required optical effect.

The application method can be, and is not limited to, the above cited screen printing or knife coating; a suitable pressure applied in the aforementioned methods to obtain a shiny effect on a textile is at least 20 N/cm$^2$, preferably in the range of 20 to 70 N/cm$^2$, more preferably 50 to 60 N/cm$^2$. Additionally, rope dyeing process may be used to apply the composition to yarns. Usual work pressure and heat on the production line in rope dyeing would make the shiny effect visible on the yarn; it has been found that the effect is maintained on a woven fabric which is obtained from these yarns.

Drying the textiles according to the process of the invention can be carried out by any conventional drying method, e.g. dry in the air or in a dryer. For example, it is possible to dry the textiles at a temperature comprised in the range of 80° C. to 200° C., preferably of 100° C. to 170° C., more preferably of 130° C., for a time comprised in the range of 10 sec to 5 min, preferably of 30 sec to 3 min, more preferably of 1 min. Advantageously, the drying can comprise more than one step; for example, it can comprise a first step at the temperature and time ranges as disclosed above, and a second fixing step at a temperature comprised in the range of 120° C. to 250° C., preferably of 150° C. to 200° C., more preferably of 180° C., for a time comprised in the ranges as disclosed above. It was found out that the ability of the microparticles to be aligned (horizontally) under pressure remains in the treated textile after the drying step, and even after washing or other treatments; therefore, the shiny effect provided by the process of the invention is not greatly and permanently reduced by treatments such as washing. For example, after the treated textile is subjected to a washing cycle, the shiny effect of the treated textile is reduced, and applying again a pressure restores the optical effect. The pressure to restore the shiny effect can be also exerted directly by the end user, e.g. with his/her fingers or with tools such as squeegees, for example after the treated textile has been washed; a pressure of about 20 to 40 N/cm$^2$, or 30 N/cm$^2$, is able to restore the shiny effect on the treated textile to which the shiny effect had been reduced. Therefore, suitable pressure to apply the composition to the textiles and obtaining a shiny effect on the textiles are preferably of at least 10 N/cm$^2$, preferably are comprised in the range of 20 to 70 N/cm$^2$.

The extent of the shiny effect of a fabric treated with the process of the invention may be measured by determining the percentage of shiny areas per unit square area of the surface of the fabric. The determination of the shiny areas, which are the areas of the fabric that display a shiny effect, can be performed by means of a digital microscope connected to a PC and a software for image processing, so that digital images of the fabric can be captured by the digital microscope and then modified with the software. A preferred method to measure the shiny effect is explained in detail in Example 2.

Figure 2:
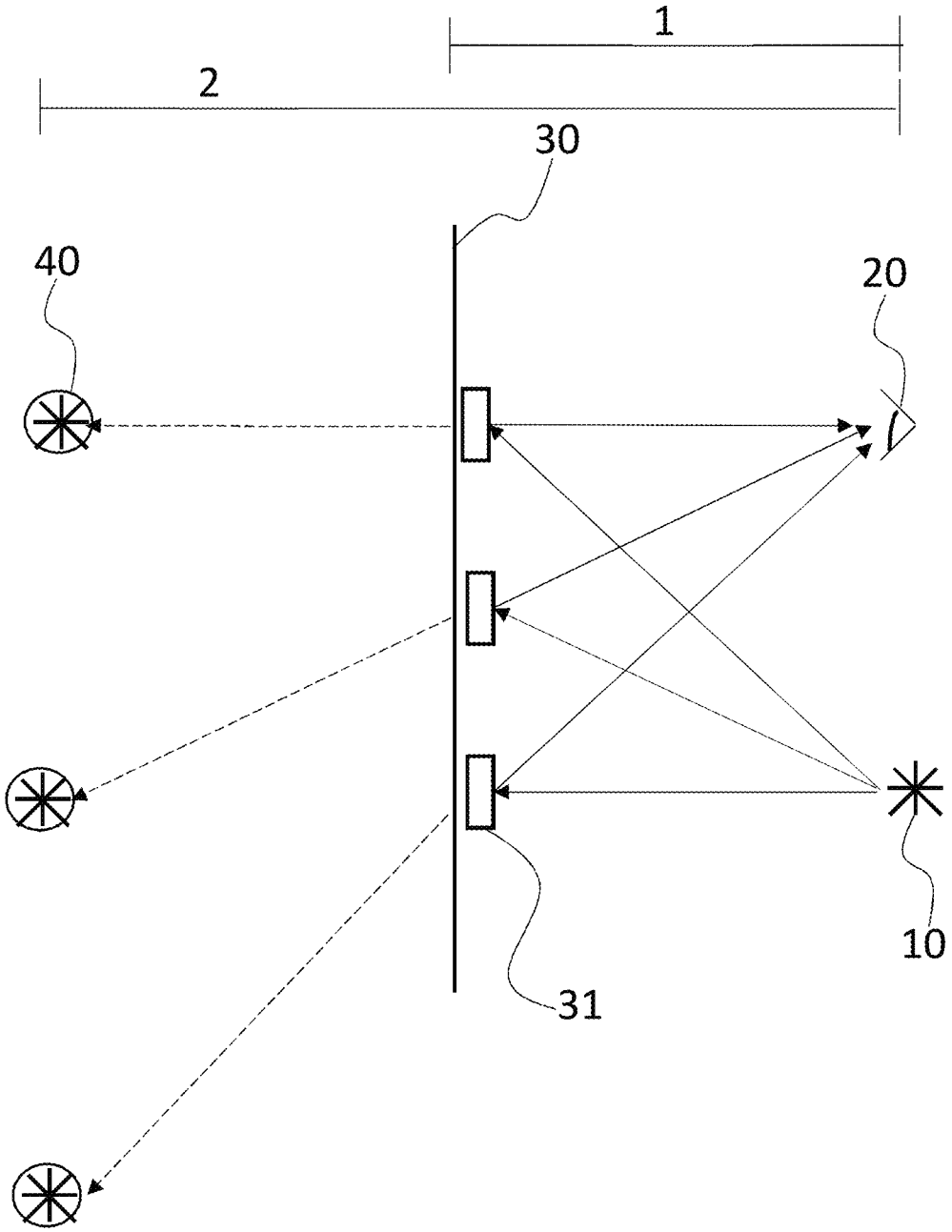
FIG. 2 is a scheme representing different focal distances of reflecting 2D particles.
Figure 3A:
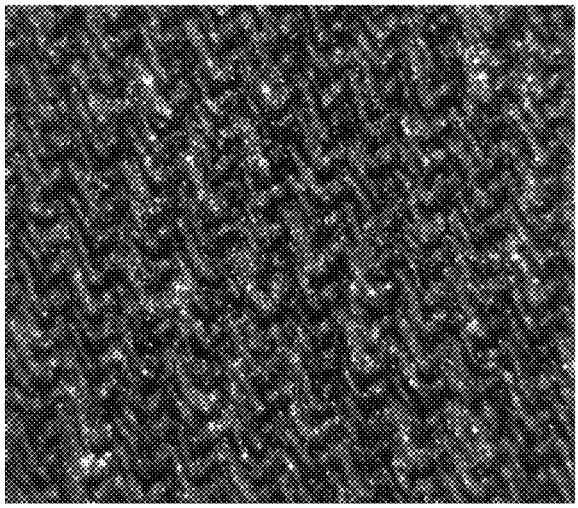
FIGS. 3A and 3B are images taken by a digital microscope of a textile of the invention coated according to the process of the invention.
Figure 3B:
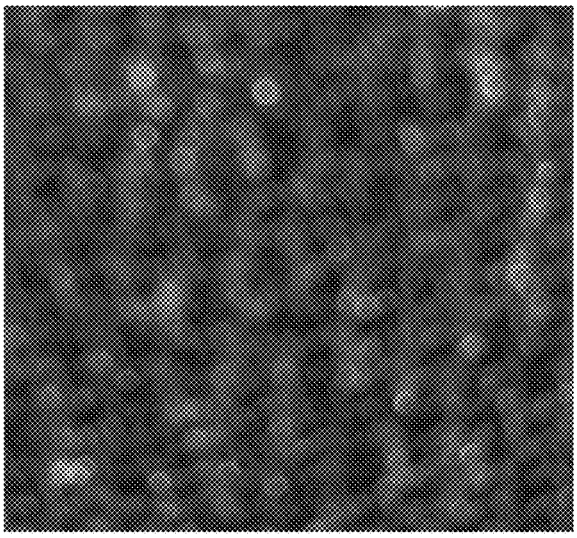

FIG. 2 represents a scheme showing the focal distances of the surface of a fabric 1 and of scattered light 2 from carbon microparticles 31 comprised on the surface 30 of such fabric. The carbon microparticles 31 scatter the light coming from the light source in the environment 10 and thereby the shiny effect on the fabric is provided. Adjusting focal distance to focus the virtual image 40 of the scattered light allows the observer 20 to better distinguish the shiny effect provided by the carbon microparticles 31 from the fabric surface 30, as can be seen from FIG. 3A (captured by digital microscope wherein focal distance was adjusted to focus fabric surface—focal distance 1) and FIG. 3B (captured by digital microscope wherein focal distance was adjusted to focus the virtual image of the scattered light—focal distance 2). To measure the shiny effect, the focal distance of means such as a digital microscope can be therefore advantageously set on the scattered light, allowing acquisition of images that can be later modified in order to determine the shiny areas. In particular, such images can be modified by an image processer, such as a raster graphics editor, for example according to Example 2 below, to determine the percentage of the shiny areas per unit square area of the fabric. A representative value of the shiny effect of the whole treated textile can be advantageously obtained by carrying out the method to measure the shiny effect herein disclosed on at least three different sample areas of the treated fabric, and then by calculating the mean. If the composition containing 2D carbon microparticles is applied only to part of a fabric, then the measurement of the extent of the shiny effect has to be carried out on such part of a fabric.

The process of the invention allows obtaining textiles coated with a composition containing 2D carbon microparticles in a carrier, wherein shiny areas on such textiles can be of at least 3%, preferably from about 3% to 30%, more preferably from about 5% to 15%, per unit square area of the fabric, measured according to the method herein disclosed. The percentages claimed in claim 10 are calculated by the method disclosed in the present application.

The invention will now be illustrated by means of the following example of coating a textile with a polymer matrix containing a 2D graphite microparticles to provide a glitter, i.e. shiny or gloss, effect, and the measurement thereof. These examples are present for illustrative purposes only and do not mean to limit the scope of the invention.

Example 1

A composition containing 2D carbon microparticles in a carrier was prepared. 25 grams of graphite flakes produced in-house by exfoliation of graphite and having dimensions comprised in the range of 125 to 43 microns (measured with an optical microscope and Malvern Dynamic Light Scattering) were dispersed into 1 kilogram of polyurethane based transparent polymer obtained by mixing EDOLAN CT (polyether polyol) and EDOLAN XCIB (aliphatic di-isocyanate). A denim fabric was prepared, having warps indigo dyed and weft yarns white. The fabric was coated with the composition by screen printing applying a pressure of about 54 N/cm2. The coated fabric was dried at 130° C. for 1 minute and fixed at 180° C. for 1 minute.

Example 2

The digital microscope DINO-LITE pro was used to capture every image to which the present Example refers to.

Figure 3C:
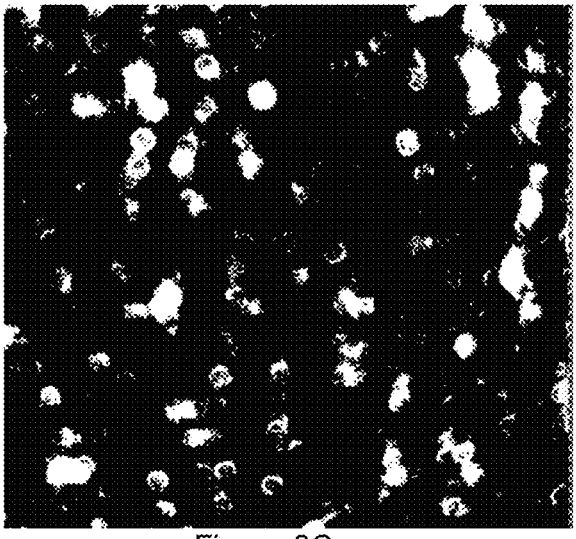
FIG. 3C is the image of FIG. 3B after it was modified with a software for image processing.

An image of the coated fabric of Example 1 (FIG. 3A) was captured by the digital microscope adjusting focal distance to focus the fabric surface. An image of the same coated fabric (FIG. 3B) was captured by the digital microscope adjusting focal distance to focus the scattered light. The percentage of shiny areas per square unit area of such coated fabric (in the present case, the fabric area was 1 cm$^2$) was determined by modifying the image captured by the digital microscope adjusting focal distance to focus the scattered light (FIG. 3B) by means of an image processing software, in particular the raster graphic editor GNU Image Manipulation Program (GIMP 2) as follows: in first instance, to each pixel of the captured image was associated a grey tone of a grayscale matrix having 256 grey tones, ranging from 0 (black) to 255 (white). Subsequently, a threshold of 80 on GIMP 2 was set, so that the pixels associated to a grey tone value greater than said threshold value were flagged as white (255 on the grey scale), while the pixels of the image associated to a grey tone value lower than said threshold value were flagged as black (0 on the grey scale). This was carried out to exclude bright area of the fabric surface that do not contribute to the shiny effect. In such a way, the pixels greater than the threshold value (i.e. the white pixels) correspond to the shiny areas, while the pixels lower than the threshold value (i.e. the black pixels) correspond to the fabric surface that does not contribute to the shiny effect. The image was then processed according to said threshold, providing an image made exclusively of black and white pixels (FIG. 3C). Finally, the percentage of shiny areas was calculated via GIMP 2 by dividing the total of white pixels for the total of black pixels and then multiplying for 100. According to the measurement herein explained, the coated fabric of Example 1 had a shiny area of 10.6% per unit square area of fabric.

Figure 4A:
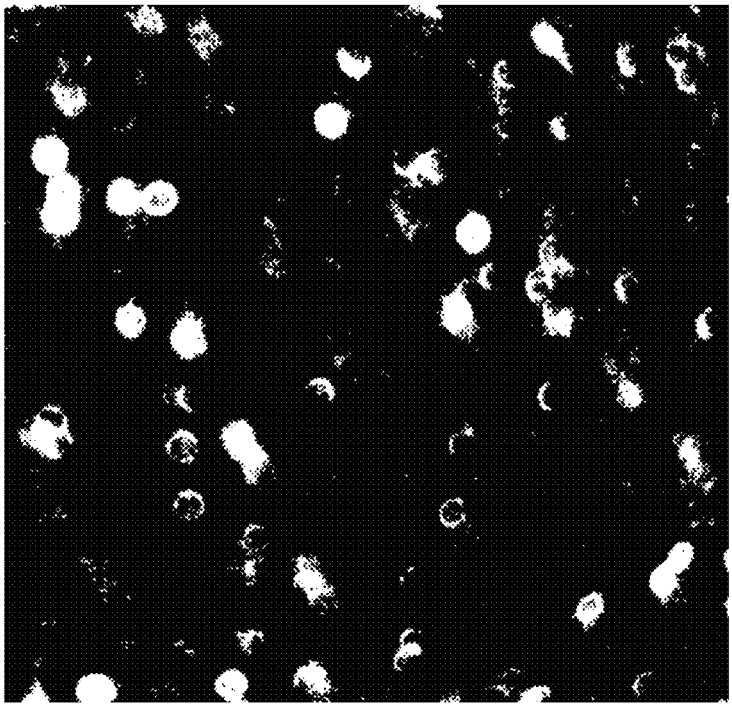
FIGS. 4A and 4B are modified images taken by a digital microscope of the textile of the invention after, respectively, three and five washes.
Figure 4B:
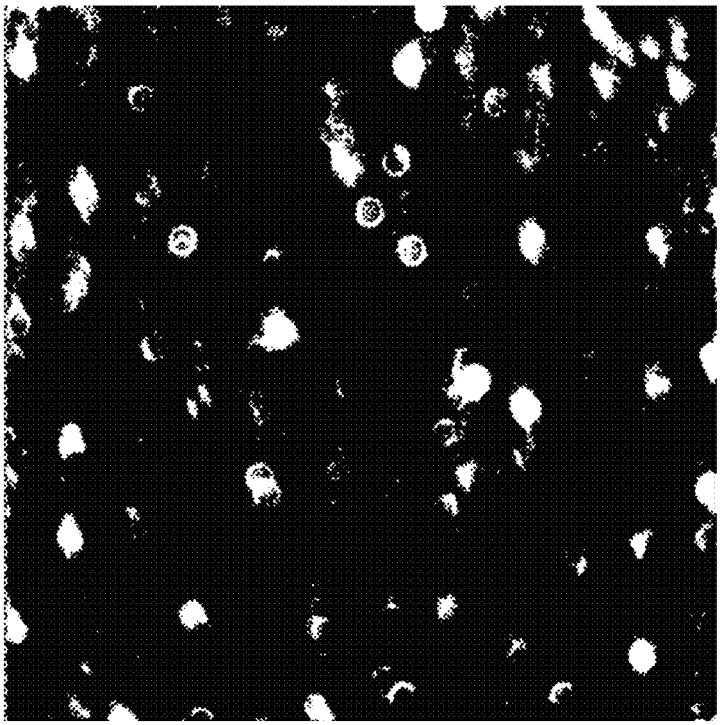

The fabric of Example 1 was subjected to three home washings. FIG. 4A is an image captured and modified as above disclosed of such fabric (three home washings). The shiny area of the fabric of FIG. 4A was 7.3% per unit square area of the fabric measured as disclosed to the above. The fabric subjected to three home washings was subjected to two further home washings (five home washings in total). FIG. 4B is an image captured and modified as above disclosed of such fabric (five home washings). The shiny area of the fabric of FIG. 4B was 6.9% per unit square area of the fabric measured as disclosed to the above.

Figure 5A:
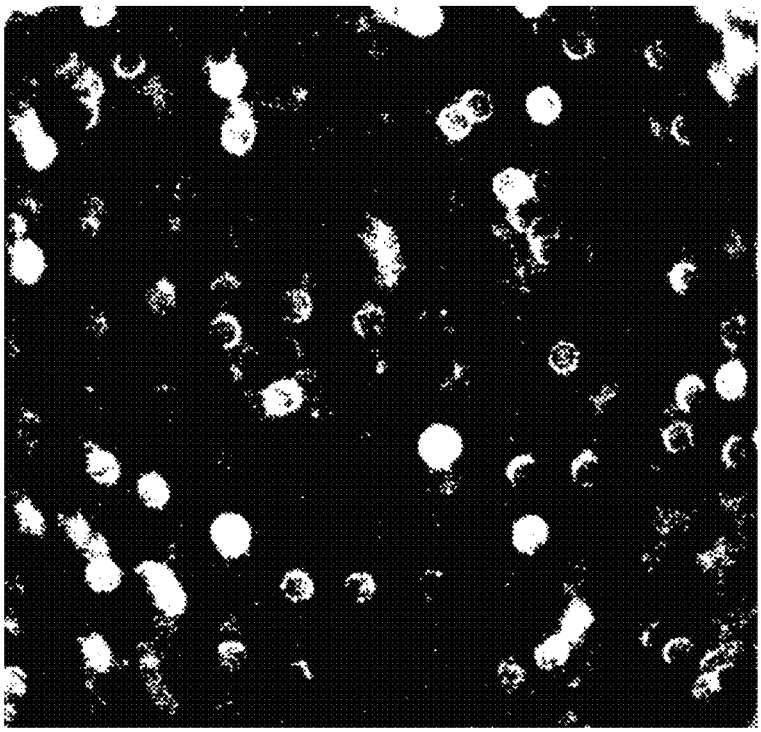
FIG. 5A is a modified image taken by a digital microscope of the textile of the invention after three washes and a pressure with a squeegee was applied.
Figure 5B:
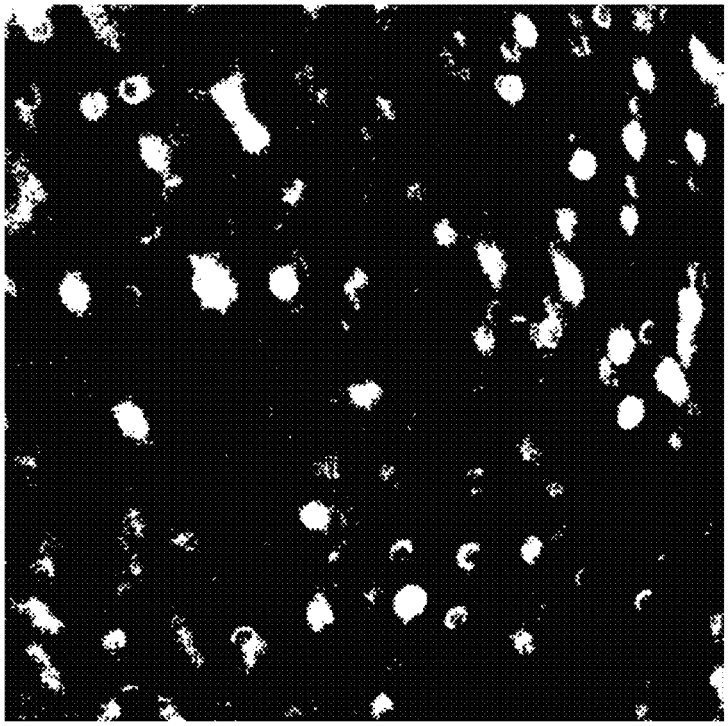
FIG. 5B is a modified image taken by a digital microscope of the textile of the invention after five washes and a pressure with a squeegee was applied.

After the fabric of Example 1 was subjected to the three home washings (before the two further home washings), a pressure of 54 $N/cm^2$ to the fabric surface was applied with a squeegee. FIG. 5A is an image captured and modified as above disclosed of such fabric (three home washings and pressure applied). The shiny area of the fabric of FIG. 5A was 8.9% per unit square area of the fabric measured as disclosed to the above. After the fabric of Example 1 was subjected to the two further home washings (five home washing in total), a pressure of 54 $N/cm^2$ to the fabric surface was applied with a squeegee. FIG. 5B is an image captured and modified as above disclosed of such fabric (five home washing and pressure applied) The shiny area of the fabric of FIG. 5B was 7.8% per unit square area of the fabric measured as disclosed to the above. FIGS. 5A and 5B thus clearly show that the shiny effect provided by the composition containing 2D carbon microparticles in a carrier, applied according to the process of the invention, is restored by applying a pressure on the coated fabric, and is not greatly and permanently reduced by treatments such as washing.

The invention claimed is:

1. A process of finishing a textile, comprising the step of preparing a composition containing 2D carbon microparticles in a carrier, applying said composition to said textile and drying said textile carrying said composition, wherein said 2D carbon microparticles are carbon microparticles having a thickness in nanometers and have a dimension in which the length of the major axis in the range of 0.1 to 250 microns.

2. The process according to claim 1, wherein said 2D carbon microparticles have dimensions in the range of 10 to 225 microns.

3. The process according to claim 1, wherein said 2D carbon microparticles are graphite flakes.

4. The process according to claim 1, wherein said carrier is transparent.

5. The process according to claim 1, wherein said carrier is selected from the group consisting of polyester polyurethanes, polyether polyurethanes and polyester polyether polyurethanes.

6. The process according to claim 1, wherein the amount of said 2D carbon microparticles is in the range of 15 g/kg to 60 g/kg of the dry composition.

7. The process according to claim 1, wherein the application of said composition to said textiles is carried out by applying a pressure to the composition of at least 20 N/cm2, whereby said composition is spread to said textiles.

8. The process according to claim 1, wherein the application of said composition to said textiles is carried out by one method selected by the group consisting of rope dyeing, screen printing and knife coating.

9. A textile as obtainable by a process according to claim 1.

10. A textile according to claim 9 coated with a composition containing 2D carbon microparticles in a carrier, wherein on such textile there are light-reflecting shiny areas amounting to at least 3%, per unit square area.

11. A textile according to claim 10 that is a fabric comprising a coating on at least part of at least a surface thereof, wherein said coating contains 2D carbon microparticles in a carrier.

12. The fabric according to claim 11, wherein said 2D carbon microparticles are graphite flakes and a dimension in which the length of the major axis in the range of 0.1 to 250 microns.

13. The fabric according to claim 11, wherein said carrier is transparent, and is selected from the group consisting of polyester polyurethanes, polyether polyurethanes and polyester polyether polyurethanes.

14. The fabric according to claim 10, wherein the amount of said 2D carbon microparticles is in the range of 15 g/kg to 60 g/kg of the dry composition.

15. A textile according to claim 10, that is a yarn comprising a coating on at least part of its surface, wherein said coating contains 2D carbon microparticles in a carrier.

16. A garment comprising the fabric as defined in claim 10 and/or a yarn comprising a coating on at least part of its surface, characterized in that said coating contains 2D carbon microparticles in a carrier.

17. The garment according to claim 16, wherein said fabric and/or said yarn are at least in part located on the outer surface of said garment.

* * * * *